United States Patent [19]

Proett

[11] 4,011,624

[45] Mar. 15, 1977

[54] CORDLESS VACUUM CLEANER

[75] Inventor: Mark Anton Proett, Towson, Md.

[73] Assignee: The Black and Decker Manufacturing Company, Towson, Md.

[22] Filed: Aug. 25, 1975

[21] Appl. No.: 607,637

[52] U.S. Cl. ..... 15/344; 15/350; 15/415 R

[51] Int. Cl.[2] ..... A47L 5/24

[58] Field of Search ..... 15/344, 350, 414, 415, 15/327 R; 415/211

[56] References Cited

UNITED STATES PATENTS

| | | | |
|---|---|---|---|
| 1,210,525 | 1/1917 | Orr | 15/415 |
| 3,230,569 | 1/1966 | Nielsen | 15/344 |
| 3,513,500 | 5/1970 | Hori | 15/344 |
| 3,584,330 | 6/1971 | Wallin et al. | 15/353 X |

FOREIGN PATENTS OR APPLICATIONS

| | | | |
|---|---|---|---|
| 327,922 | 4/1930 | United Kingdom | 15/344 |

*Primary Examiner*—Christopher K. Moore
*Attorney, Agent, or Firm*—Edward D. Murphy; Leonard Bloom

[57] ABSTRACT

A battery-operated vacuum cleaner is described which includes a first module including a source of power such as a plurality of battery cells and a second module including a motor, fan, filter and dirt receptacle. The first module may alternatively include means for attachment thereof to a car battery. The motor, fan and filter combination are designed for maximum efficiency so as to provide good cleaning capability with minimum battery drain. The intake portion of the tool is designed, in accord with the particular teachings of this invention, to provide maximum cleaning capability.

10 Claims, 5 Drawing Figures

CORDLESS VACUUM CLEANER

BACKGROUND OF THE INVENTION

A wide variety of products have been available for many years for performing spot vacuuming or automotive vacuuming which are powered by batteries. Frequently this is accomplished by providing a cord which can be plugged into the cigarette lighter outlet of an automobile. Most such units are simply not capable of adequate performance; furthermore, units designed to be completely portable by means of integral batteries are even more deficient in cleaning capability and usage time. It has now been found that adequate cleaning performance can be obtained from a battery-operated unit, and even from a low voltage battery of limited current capacity.

SUMMARY OF THE INVENTION

The vacuum cleaner of the present invention includes either an integral or separate battery as a source of power, a switch to control the application of battery power to the motor, a motor and fan combination, a filter and canister assembly for removing dirt from the air stream and containing it, an intake nozzle and an outlet from the fan. In accord with the preferred embodiment of this invention, the batteries and switch may be provided in an independent module which may be used as a common power source for a variety of other tool heads. This concept is more completely described and claimed in the copending application of Owings, et al., Ser. No. 500,131, filed Aug. 23, 1974 and assigned to the assignee of this invention, now U.S. Pat. No. 3,952,239, the specification of which is incorporated herein by reference. In particular accord with the present invention, the intake region is designed to overcome prior art problems of wasted energy and inefficient cleaning by providing a constant area for air flow from the pick up region to the interior of the dirt-receiving canister. In further accord with the invention, the exhaust portion of the unit, at which clean air exits from the fan, includes a large area diffuser which exhausts immediately into the atmosphere and includes no additional air passage. The purpose of this construction is to overcome the difficulties of the prior art as mentioned above and to provide a cordless electric vacuum cleaner which exhibits not only greatly improved efficiency in terms of operating time available from a given battery capacity, but also a greatly improved cleaning capability. Further objects and advantages of this invention will become apparent as the description and illustration thereof proceed.

IN THE DRAWING

Figure 1:
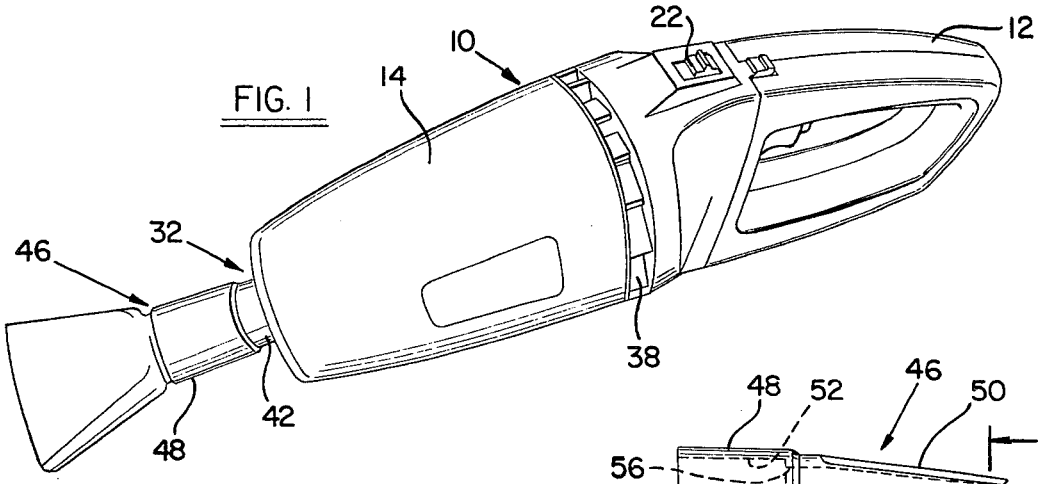
FIG. 1 is a perspective view of a cordless electric vacuum cleaner constructed in accordance with the present invention.
Figure 1:
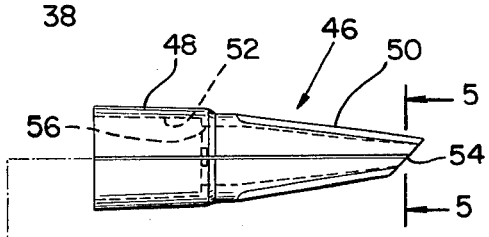
Figure 2:
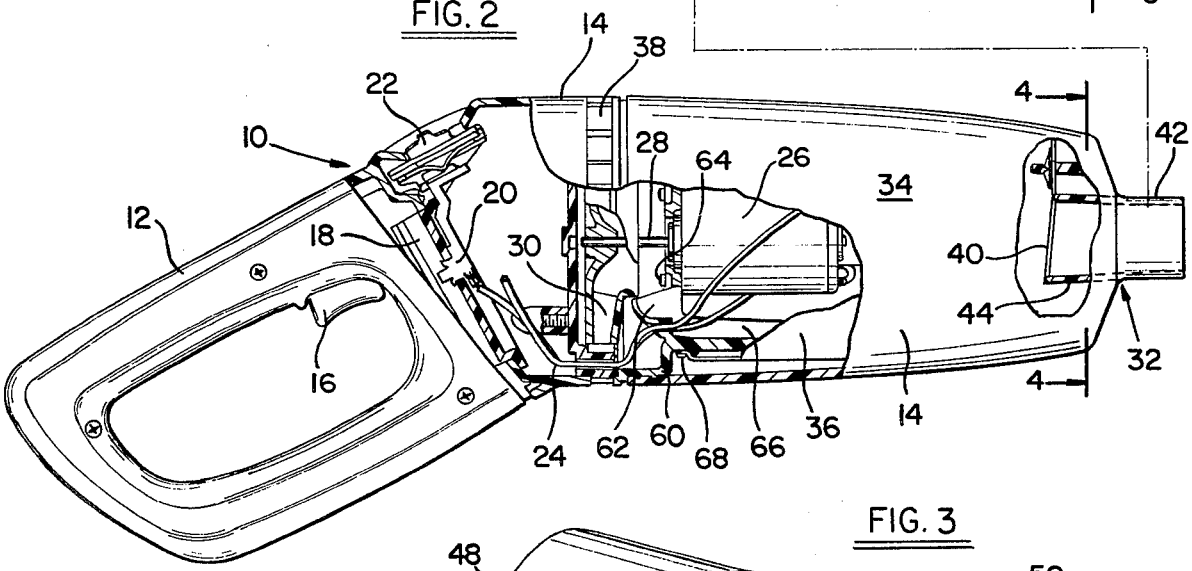
FIG. 2 is a side elevation, partially in section, of the cordless vacuum cleaner of FIG. 1.
Figure 3:
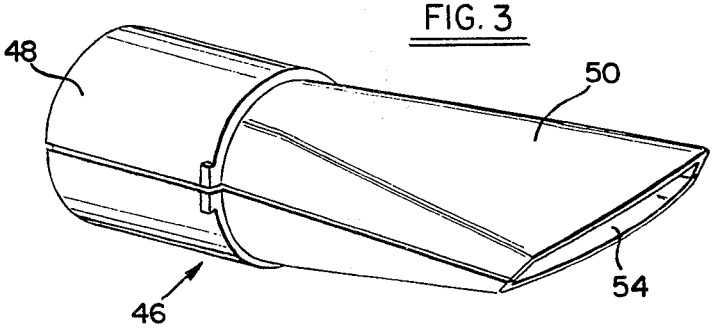
FIG. 3 is a perspective view of the nozzle attachment included in the cleaner of FIGS. 1 and 2.

The cordless electric vacuum cleaner shown generally at 10 in FIGS. 1 and 2 comprises a power handle module 12 and a tool head module 14. The power handle module may be of the type described and claimed in the aforementioned application of Owings, et al; generally, it includes a plurality of battery cells and a switch under the control of trigger 16. Alternatively, the power handle may simply be used to provide a hand grip and may include a switch for controlling the application of power through a cord which is connectable to another source of power such as an automotive battery.

The power handle is detachably secured to the rearward end of the tool head module 14 via a complementary system of ribs 18 or other suitable interconnection means as is more completely described in the Owings, et al application. The handle also includes suitable electrical contacts for applying power to the contacts 20 of tool head 14. The battery power may be applied to the contacts 20 on a momentary basis by using the trigger switch 16 which is biased toward its off position or alternatively, the two position switch 22 in the tool head 14 may be actuated if it is desired to allow the motor to run continuously. In either operational mode, power is applied through suitable wires 24 to an electric motor 26 contained within the tool head module. The motor is connected via shaft 28 to a fan 30 which is arranged to draw air inwardly through the intake portion 32 of an enclosing canister 34. The air flow then passes through a porous filter bag 36 and clean air passes through the fan and exhausts via diffuser 38. To ensure retention of the dirt within the canister 34, a small flexible rubber flap valve 40 may be provided adjacent the intake nozzle.

The present invention is based essentially on the realization that maximum cleaning capability in a limited power unit depends critically on the intake nozzle structure. In accordance with this concept, the canister 34 includes, preferably as an integral extension thereof, an intake aperture defined by a forwardly extending cylindrical portion 42 and a rearward portion 44 extending within the canister 34. The important aspect of these cylindrical members 42 and 44 is that the inner diameter thereof, or at least the inner cross-sectional area thereof is substantially continuous from the outward end of cylinder 42, to the right in FIG. 2, to the inward end of cylinder 44, to the left in FIG. 2. This specific condition defines an air flow path for dirt-laden air which ensures that the velocity of air and dirt particles through the two cylinders will be substantially constant.

The intake region 32 in accordance with the present invention further includes a nozzle 46. The nozzle includes a rearward, coupling portion 48 and a forward, pick up region 50. The coupling portion 48 comprises an inner diameter 52 which is adapted to tightly fit over the outside of cylinder 42 so as to be securely but removably attached thereto. The pick up portion 50 is tapered to provide a wide, flat intake 54 which is more useful for most spot cleaning jobs.

Internally, the nozzle 46 comprises a shoulder 52 which abutts the leading end of cylinder 42 in the assembled configuration. As previously noted, it is of critical importance that the cross-sectional area of the cylinders 42 and 44 be substantially continuous. Similarly, the cross-sectional area of the interior of the nozzle 46 is substantially constant, and equal to that of the cylinders 42 and 44, from the shoulder 52 forwardly to the intake 54.

Figure 4:
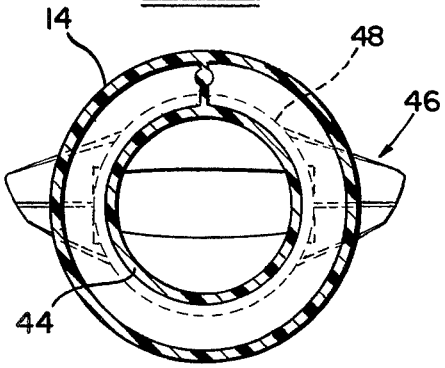
FIG. 4 is a sectional view taken along the lines 4—4 of FIG. 2.
Figure 5:
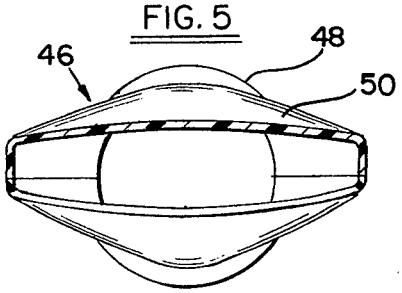
FIG. 5 is a sectional view taken along the lines 5—5 of FIG. 2.

FIGS. 4 and 5 illustrate this concept in that FIG. 4 is a cross-sectional view taken through the rearward cylinder 44 looking forwardly while FIG. 5 is a view of the frontal area of the nozzle substantially at 54. The areas in question in these views are the area bounded by the inner wall of cylinder 42 in FIG. 4 and the area of the intake as defined in a plane perpendicular to the air flow through the intake. Thus, this plane lies intermediate the leading edges of the upper and lower surfaces of the intake 54 because the opening 54 is not perpendicular to the air flow. However, the area which affects the air flow at that point is that in the plane normal to the flow path.

Throughout these areas, that is, from the plane normal to the air path at the intake 54 through the nozzle to the shoulder 56 and through the intake cylinders 42 and 44 of canister 34, the air flow path area is substantially constant; that is, without more than a 10 percent variation throughout this entire length.

The purpose of this construction is to ensure that dust or dirt particles entrained in the air stream are carried through into the container without being dropped from the air stream in the nozzle; and to ensure that the air stream passes through the nozzle without variation in its velocity. If the velocity of the air stream in the nozzle is varied, excessive energy may be consumed without useful benefit. For example, if the air stream velocity reduces at any point between the intake and the container but still moves at a sufficient velocity to keep dirt particles entrained, then energy has been wasted in raising the air stream and particles to an unnecessarily high initial velocity. On the other hand, if the initial velocity at the intake is high enough to pick up dirt particles and introduce them into the nozzle, then there is no need to increase the velocity further. Finally, in addition to these considerations of unnecessary changes in velocity, this invention is partially based on the realization that the action of changing the velocity of the air steam within the nozzle itself causes a wasteful loss of energy.

Another aspect of the present invention is the abrupt change from the fixed, limited area of the intake system to the large area of the container. This abrupt change in diameter of the available air flow path causes a similarly abrupt decrease in the velocity of the air stream and of entrained dirt particles. Accordingly, a substantial portion of the particles will immediately be dropped from the dirt stream at this point and will not be carried further to the filter bag 36. Thus, this configuration assists in allowing the unit to operate at a higher efficiency for a longer period of time before the bag becomes clogged. In a particular embodiment of this invention, the power handle 12 incorporates four nickel cadmium battery cells and the motor-fan combination used therewith are designed to produce a nominal air flow velocity, with a clean bag, of approximately 3,900 feet per minute. Given possible variation of filter clogging and voltage between full charge and discharge, this air velocity may range from 2,500 to 4,500 feet per minute. While obviously a unit operating with batteries nearly discharged and with the bag nearly full will not provide optimum performance, the range of air velocity of from 3,000 to 5,000 feet per minute has been found to be suitable for dust collection. The nozzle area used in association with this system is 1.1 square inches and this area is consant throughout the nozzle and internal cylinders to within 10 percent. This produces an air flow of from 20 to 35 cubic feet per minute, or approximately 29 cubic feet per minute with a clean bag and batteries at nominal charge. Because of the structure previously described, this has been found to produce good cleaning performance for an extended operating time.

To complete the internal sructure of the vacuum cleaner module, the canister 34 is mounted on a support member 60 which includes radially inwardly extending ribs 62 to which the motor is attached, for example, by bolts 64. The ribs also include axially extending portions 66 upon which the filter bag 36 is mounted. The bag may be retained by suitable means such as an elastic band 68.

The air flow passes from the intake assembly through the flapper valve 40 and through the container 34 to the filter bag 36. After passing through the bag, the clean air passes between the ribs 62 into the fan 30 and then outwardly to atmosphere through the diffuser 38. The diffuser increases the pressure differential obtained through the use of a given fan, thus further increasing the efficiency of the system. A further aspect of this invention is the provision of a centrifugal fan with a radially disposed diffuser substantially completely surrounding the outlet from the fan, the diffuser then communicating directly to atmosphere. By virtue of this construction, the structural unity between the power source and the dirt-receiving canister, motor and fan assembly is defined by the diffuser vanes, which also serve to increase the efficiency of the fan. In addition, because of the circumferential disposition of the diffuser, immediate exhaust of the air to atmosphere is permitted, thus eliminating the back pressure which is commonly introduced by the exhaust passageways provided in many prior art constructions. Accordingly, this particular radial arrangement of fan, diffuser and immediate exhuast to atmosphere comprises a significant feature of the construction of this invention.

As previously noted, previous low voltage vacuum cleaners operated from batteries have primarily been of the type designed to be operated directly from an automotive battery. While these are not comparable to units operated from line power, the automotive battery still provides a very large supply of energy and permits the unit to be designed so that it draws a very large current. Despite this available power, most units of this type are not capable of good cleaning performance. Furthermore, in the particular context of units provided with integral battery power supplies, the very serious limitation on battery capacity has previously made it difficult if not impossible to design a unit which can clean adequately for a reasonable length of time. The structure of the present invention overcomes these disadvantages by means of the above-described structural features. It has been found that the results obtained by using these features in an integral battery-powered unit of the type illustrated are equal to the best previously available automotive battery-powered units and are better than known portable units with integral batteries. The alternative embodiment of this invention which provides for attachment to an automotive battery incorporates correspondingly improved performance.

While one specific embodiment of this invention has been illustrated and described, and certain alternatives have been briefly mentioned, it will be clear to those skilled in the art that various changes and modifications can be made from the illustrated construction while still incorporating the essential teachings of this invention. Accordingly, it is intended that the appended claims cover all such changes and modifications as may fall within the true spirit and scope of this invention.

I claim:

1. A battery-operated electric vacuum cleaner comprising an electric motor; switch means for connecting said motor to a battery for energization thereof; a fan driven by said motor; a canister for retaining dirt picked up by the cleaner; a filter bag mounted in said canister and arranged to remove dirt from the air stream produced by said fan; and an intake for said canister, said intake comprising a passageway opening into said canister, said passageway having a substantially constant cross sectional area throughout its length; and a diffuser disposed at the outlet of said fan opening directly to the atmosphere for reducing back pressure across said fan and increasing the efficiency of said unit.

2. A vacuum cleaner as claimed in claim 1 wherein said intake terminates within said canister and wherein the cross sectional area of said canister at the termination of said intake is substantially larger than said area of said intake.

3. A vacuum cleaner as claimed in claim 2 wherein the cross-sectional area of said canister is at least twice the cross-sectional area of said intake at the point of termination of said intake.

4. A portable, battery-powered electric vacuum cleaner comprising a housing, a battery enclosed within said housing; a motor enclosed within said housing; switch means for controlling the connection of said battery to said motor; a fan driven by said motor; a portion of said housing comprising a dirt-retaining canister for conducting the air flow generated by said fan; said canister including an intake nozzle for application to a surface for cleaning dirt therefrom, said nozzle comprising a surface encompassing a cross-sectional area, said cross-sectional area remaining substantially constant throughout the length of said intake nozzle; and a diffuser positioned between the outlet from said fan and the atmosphere for increasing air flow through said cleaner.

5. A vacuum cleaner as claimed in claim 4 wherein said area of said intake nozzle is constant throughout the length of said nozzle to within a maximum variation of ten percent of said area.

6. A battery-operated electric vacuum cleaner comprising a handle, an electric motor, a fan driven by said motor and switch means for controlling the connection of said motor to a battery for energization thereof; said vacuum cleaner includng a subatantially cylindrical dirt-receiving canister; an intake adjacent one end of said canister; a centrifugal fan adjacent the other end of said canister; an annular diffuser circumferentially enclosing said fan and structurally supporting said canister; said diffuser being supported from said handle for converting kinetic energy of air exiting from said fan and increasing the pressure differential across said cleaner.

7. A vacuum cleaner as claimed in claim 6 wherein said diffuser comprises a plurality of spaced vanes circumferentially enclosing said centrifugal fan.

8. A battery-operated electric vacuum cleaner comprising a centrally located housing member; a handle exending from one side of said central housing member; means on said central housing member for detachably receiving said handle; an annular diffuser extending from the other side of said central housing member; a centrifugal fan disposed radially within said diffuser; an electric motor for driving said fan; switch means for controlling the connection of said motor to a battery for energization thereof; a generally cylindrical canister supported from said diffuser, said canister being disposed on the opposite side of said diffuser from said central housing member; an intake nozzle disposed at the opposite end of said canister from said diffuser, said intake nozzle having a substantially constant cross-sectional area throughout its length.

9. A vacuum cleaner as claimed in claim 8 and further comprising battery means enclosed within said handle.

10. A battery-operated electric vacuum cleaner comprising a centrally located housing member; a handle extending from one side of said central housing member; means on said central housing member for detachably receiving said handle; an annular diffuser extending from the other side of said central housing member; a centrifugal fan disposed radially within said diffuser; an electric motor for driving said fan; switch means for controlling the connection of said motor to a battery for energization thereof; a generally cylindrical canister supported from said diffuser, said canister being disposed on the opposite side of said diffuser from said central housing member; an intake nozzle disposed at the opposite end of said canister from said diffuser, said intake nozzle comprising a substantially cylindrical wall member extending through one end of said canister, said cylindrical wall member defining an opening having a constant internal cross-sectional area; said intake nozzle further comprising a detachable tool, said tool having an internal cross-section tapering from an outwardly located rectangular slot to a cylindrical opening internally of said tool, the cross-sectional area of said tool throughout its length being substantially equal to that of said cylindrical wall.

* * * * *